US009044939B2

(12) United States Patent
Gonzales et al.

(10) Patent No.: US 9,044,939 B2
(45) Date of Patent: Jun. 2, 2015

(54) PRINTHEAD ASSEMBLY PRIMING

(71) Applicant: HEWLETT-PACKARD DEVELOPMENT COMPANY, L.P., Houston, TX (US)

(72) Inventors: Curt Gonzales, Corvallis, OR (US); Jeana M. Kanyer, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/160,610

(22) Filed: Jan. 22, 2014

(65) Prior Publication Data

US 2014/0132656 A1 May 15, 2014

Related U.S. Application Data

(63) Continuation of application No. 13/240,988, filed on Sep. 22, 2011, now Pat. No. 8,668,319.

(51) Int. Cl.

| | |
|---|---|
| ***B41J 2/19*** | (2006.01) |
| ***B41J 2/07*** | (2006.01) |
| ***B41J 2/17*** | (2006.01) |
| ***B41J 2/175*** | (2006.01) |

(52) U.S. Cl.

CPC .... *B41J 2/07* (2013.01); *B41J 2/19* (2013.01); *B41J 2/1707* (2013.01); *B41J 2/175* (2013.01); *B41J 2/17513* (2013.01); *B41J 2/1752* (2013.01); *B41J 2/17556* (2013.01)

(58) Field of Classification Search

CPC ..... B41J 2/19; B41J 2/195; B41J 2202/07; B41J 2/175

See application file for complete search history.

(56) References Cited

U.S. PATENT DOCUMENTS

| | | | | |
|---|---|---|---|---|
| 6,513,920 | B1 | 2/2003 | Deshmukh et al. | |
| 7,361,210 | B2 | 4/2008 | Olsen | |
| 7,488,060 | B2 * | 2/2009 | Umeda | 347/85 |
| 7,637,579 | B2 | 12/2009 | Nishida | |
| 7,682,008 | B2 | 3/2010 | Platt et al. | |
| 7,722,170 | B2 | 5/2010 | Morgan et al. | |
| 2005/0007427 | A1 * | 1/2005 | Bellinger et al. | 347/86 |

FOREIGN PATENT DOCUMENTS

| | | |
|---|---|---|
| JP | 2002219815 | 8/2002 |

* cited by examiner

*Primary Examiner* — Geoffrey Mruk

(74) *Attorney, Agent, or Firm* — Hewlett-Packard Patent Department

(57) ABSTRACT

In one example, a liquid dispensing device includes a printhead assembly having a liquid port through which liquid may move between a removable liquid container and the printhead assembly and an air port through which air may flow to and from the container. A pressure source is operatively connected to the air port to pressurize the container to push liquid from the container through the liquid port into the printhead assembly. A vent is operatively connected to the air port to vent the pressurized container to draw froth from the printhead assembly through the liquid port into the container. In another example, a method for priming a printhead assembly includes pushing liquid from a container into the printhead assembly through a liquid port and then pulling froth from the printhead assembly into the container through the liquid port.

18 Claims, 13 Drawing Sheets

PRINTHEAD ASSEMBLY PRIMING

CROSS REFERENCE TO RELATED APPLICATIONS

This is a continuation of and claims priority to application Ser. No. 13/240,988, Printhead Assembly Priming, filed Sep. 22, 2011.

BACKGROUND

In some inkjet printers, ink is supplied to the printhead from or through a discrete ink supply reservoir that is separate from the printhead assembly. Air may enter the printhead assembly when ink in the supply reservoir is depleted and the reservoir is replaced or refilled. Air in the printhead assembly may impede the flow of ink to the printhead and, therefore, the ink supply system must be able to manage the air in the printhead assembly to minimize possible adverse affects on printing.

DRAWINGS

The same part numbers are used to designate the same or similar parts throughout the figures.

DESCRIPTION

Examples of a new technique for introducing ink into an inkjet printhead assembly are shown in the Figures and described below. The new technique was developed to help improve filling a printhead assembly with ink when there is a substantial volume of air in the printhead assembly, for instance during the initial printer start-up and when replacing or refilling a depleted ink supply reservoir. Introducing ink or another liquid into a printhead assembly is commonly referred to as "priming" the printhead assembly. Although examples implementing the new priming technique are described with reference to an inkjet printer, the new technique is not limited to inkjet printers or inkjet printing but might also be implemented in other types of liquid dispensers.

The examples shown in the figures and described below, therefore, illustrate the invention but do not limit the scope of the invention, which is defined in the Claims following this Description.

The movement of air in the printhead assembly during ink fill operations can generate ink/air froth. More pressure is required to remove froth from the printhead assembly than is required to remove air alone. The printhead assembly cannot completely fill with ink unless froth is removed from the printhead assembly. Thus, in one example of a new liquid dispensing device, a suitable pressure source is operatively connected to a liquid supply container to pressurize the container to push liquid from the container through a liquid port into the printhead assembly. The pressurized container is then vented under conditions sufficient to draw froth from the printhead assembly through the liquid port into the container. In one specific example for an inkjet printer, the conditions sufficient to draw froth from the printhead assembly into the container include a pressure difference across the ink port between the printhead assembly and the container of at least 25 inches of water. The pressure/vent cycle may be repeated until a sensor indicates that the printhead assembly is full or until a predetermined number of cycles are completed.

As used in this document, "printhead assembly" means that part of an inkjet type liquid dispensing device that expels drops or streams of ink or other liquids; and "liquid" means a fluid not composed primarily of a gas or gases. For convenience, printhead assembly is sometimes abbreviated herein as "PHA."

Figure 1:
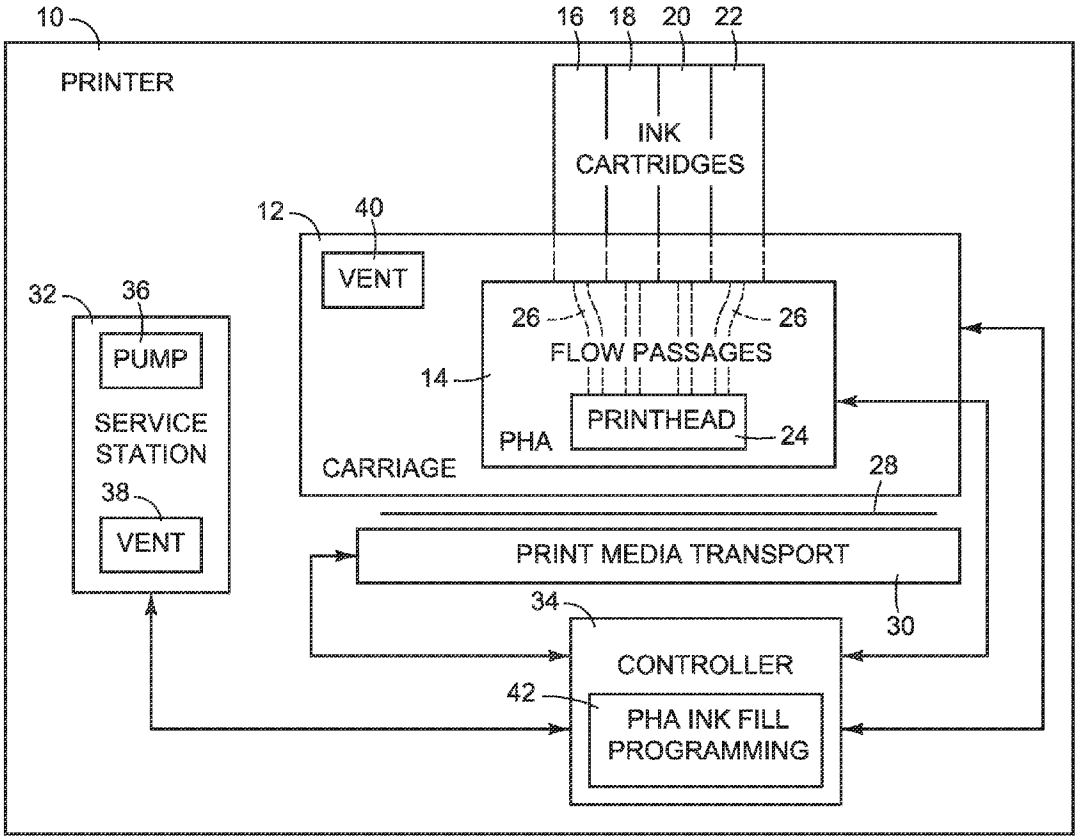
FIG. 1 is a block diagram illustrating an inkjet printer in which examples of a new printhead assembly priming technique may be implemented.

FIG. 1 is a block diagram illustrating an inkjet printer 10 in which examples of the new printhead assembly priming technique may be implemented. Referring to FIG. 1, printer 10 includes a carriage 12 carrying a printhead assembly 14 and a series of replaceable ink cartridges 16, 18, 20, and 22 connected to a printhead assembly 14. Each ink cartridge may hold a different color ink, such as black (K), yellow (Y), cyan (C), and magenta (M). Each ink cartridge 16-22 represents generally any suitable local ink supply for printhead assembly 14. For example, each ink cartridge 16-22 may be a self-contained "on axis" ink supply for printhead assembly 14. For another example, each ink cartridge 16-22 may be a local supply reservoir and pressure regulator for a larger, "off axis" ink supply.

Printhead assembly 14 includes a printhead 24 and flow passages 26 between printhead 24 and ink cartridges 16-22. Printhead 24 represents generally the operative components needed to expel ink from printhead assembly 14 on to a print medium 28. An inkjet printhead 24 is usually a small electromechanical assembly that contains an array of miniature thermal, piezoelectric or other devices that are energized or activated to eject tiny droplets or a stream of ink out of an associated array of nozzles. Printhead 24 may be formed as a series of discrete printheads each integrated into or otherwise serving one or more ink cartridges 16-22, or as a single printhead serving all of cartridges 16-22 through multiple nozzle arrays and corresponding fluid delivery channels.

A print media transport mechanism 30 advances print medium 28 past carriage 12 and printhead 24. For a movable, scanning carriage 12, media transport 30 typically will advance medium 28 incrementally past printhead 24, stopping as each swath is printed and then advancing medium 28 for printing the next swath. For a stationary carriage 12, media transport 30 may advance print medium 28 continuously past printhead 24.

Printer 10 also includes a service station 32 and a controller 34. Service station 32 includes an air pump or other suitable source of pressurized air 36, a vent 38, and other components (not shown) for servicing printhead assembly 14. As described in more detail below, pump 36 is connected to an air manifold in printhead assembly 14 when carriage 12 is moved to service station 32. During a printhead assembly priming operation, pump 36 pressurizes one or more ink cartridges 16-22 to push ink into printhead assembly 14 and then the pressure is vented through service station vent 38 or through a vent 40 on carriage 12 to draw froth out of printhead assembly 14 into a corresponding ink cartridge 16-22.

Controller 34 represents generally the programming, processor and associated memory, and the electronic circuitry and components needed to control the operative elements of a printer 10. In particular, controller 34 includes programming 42 for priming printhead assembly 14. While it is expected that priming programming 42 on controller 34 will usually be implemented in an ASIC (application specific integrated circuit) or firmware residing on printer 10, other suitable configurations for programming 42 are possible. For example, programming 42 could be implemented through software residing on printer 10 or remote from printer 10.

Figure 2:
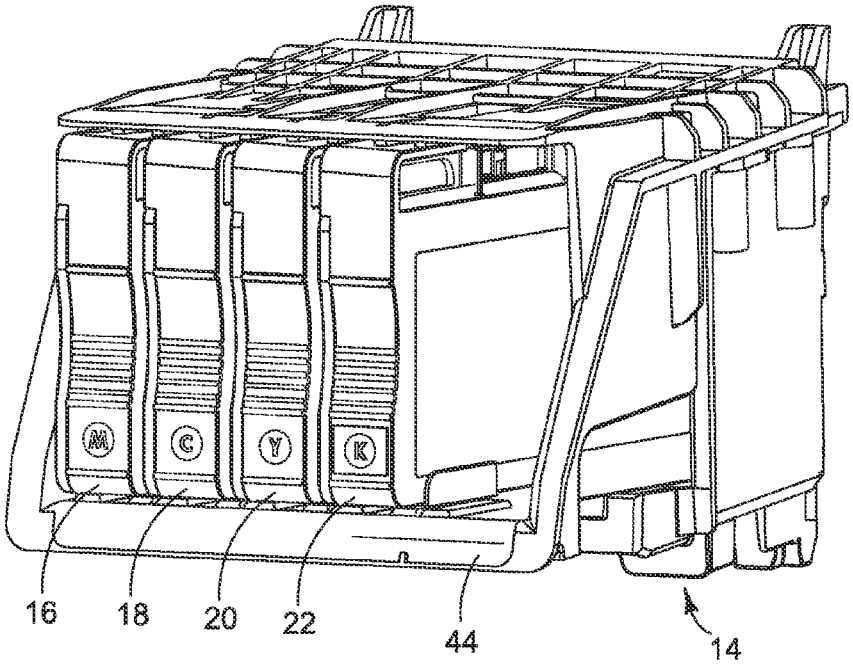
FIGS. 2 and 3 illustrate one example configuration for a printhead assembly and ink cartridges such as might be used in the printer shown in FIG. 1.
Figure 3:
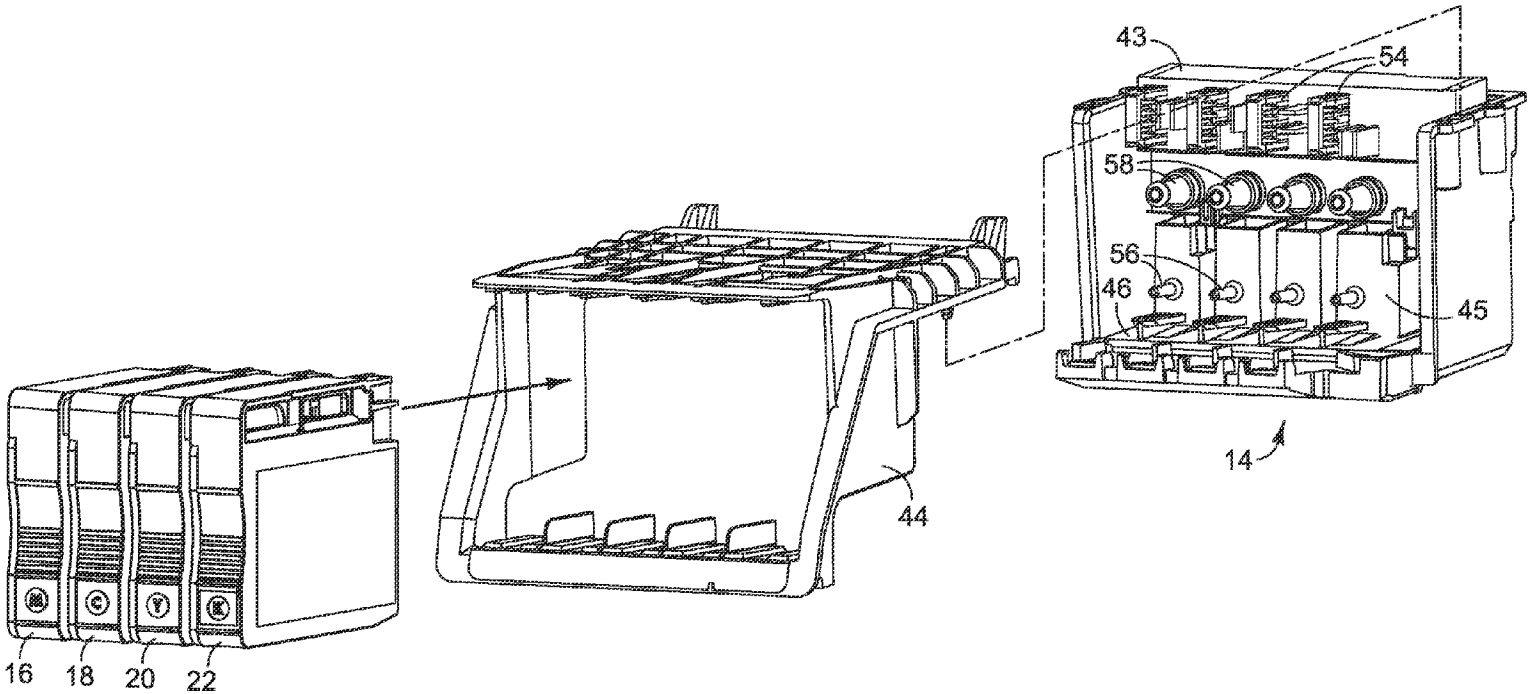
Figure 4:
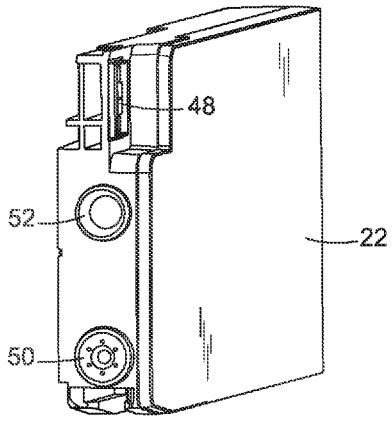
FIG. 4 is a detail view of one of the ink cartridges from FIGS. 2 and 3.
Figure 5:
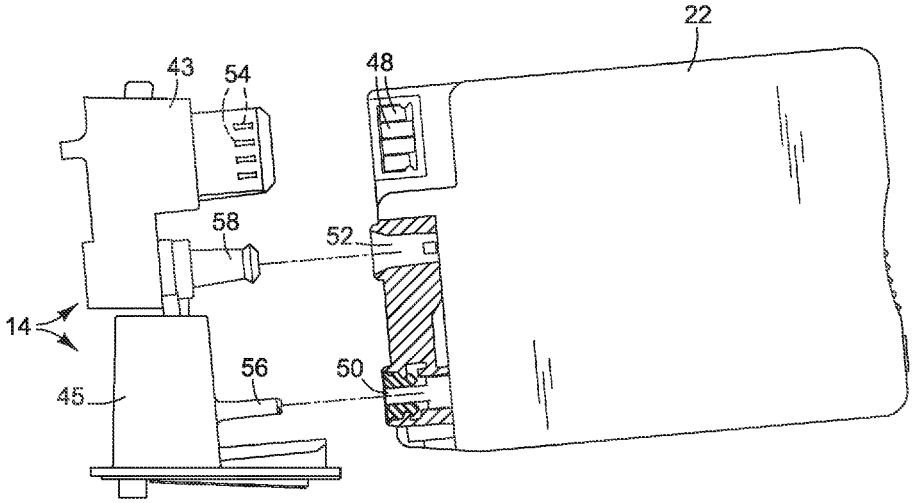
FIGS. 5-7 are detail views illustrating one of the ink cartridges and the printhead assembly of FIGS. 2 and 3.
Figure 6:
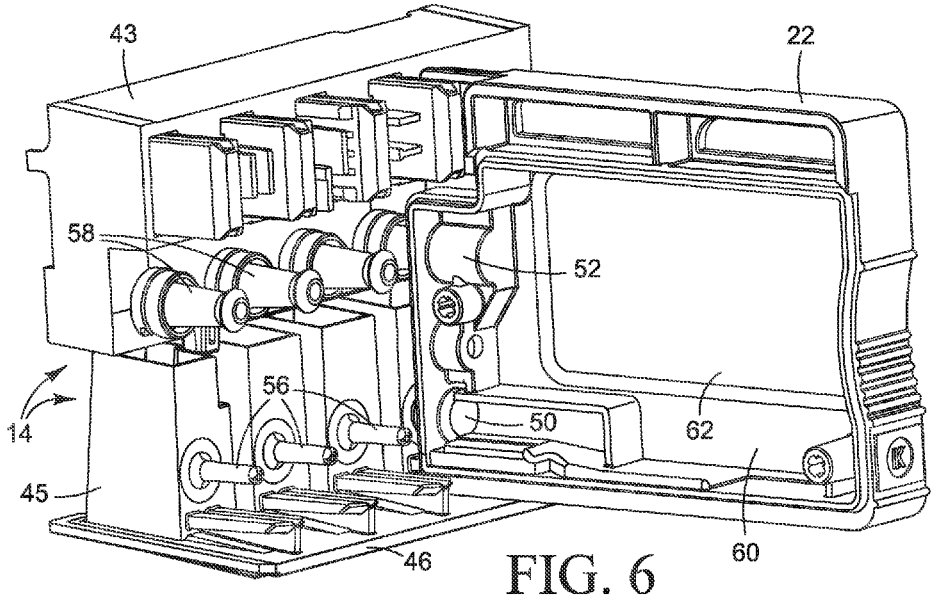
Figure 7:
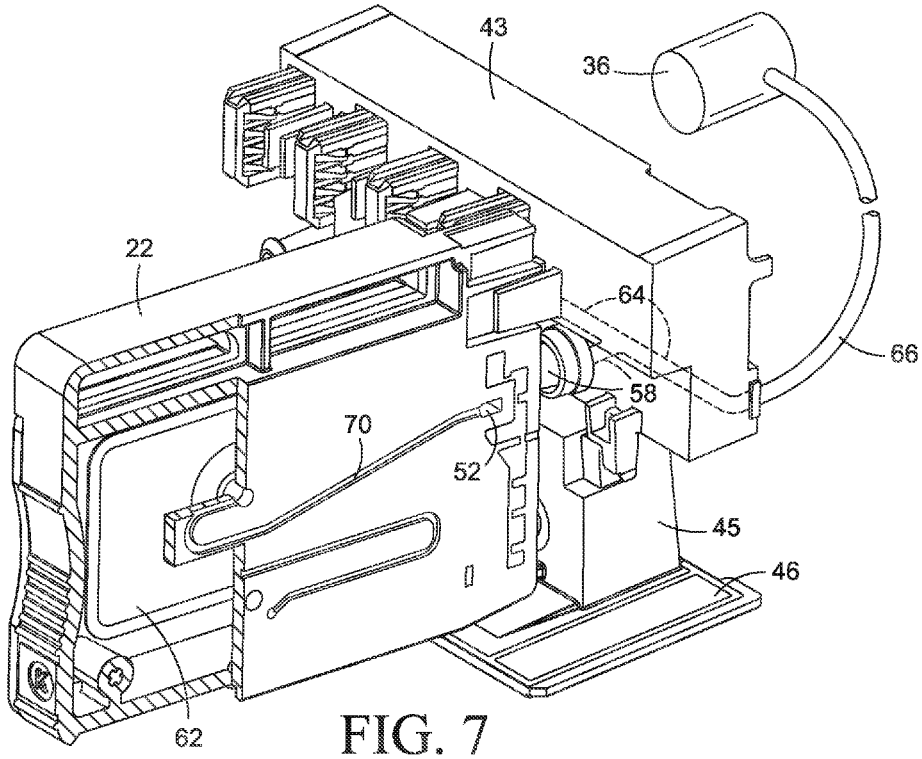

FIGS. 2 and 3 illustrate one example configuration for a printhead assembly 14 and ink cartridges 16-22, such as might be used in printer 10 shown in FIG. 1. FIG. 4 is a detail view of one of the ink cartridges 16-22, cartridge 22 for example, and FIGS. 5-7 are detail views showing cartridge 22 inserted into printhead assembly 14. Only the upper parts of PHA 14 are shown in FIGS. 2-7—an upper housing 43 and a middle housing 45. A lower housing for printhead 24 (FIG. 1) is not shown in FIGS. 2-7.

Referring to FIGS. 2-7, when inserted into printhead assembly 14, ink cartridges 16-22 are supported in a holder 44 and along a base part 46 of printhead assembly 14. Each ink cartridge 16-22 includes an electrical interface 48, an ink port 50, and an air port 52 that connects to a corresponding electrical interface 54, ink port 56, and air port 58 on printhead assembly 14. As shown in FIG. 6, cartridge ink port 50 is connected to an ink reservoir 60 in cartridge 22. As shown in FIG. 7, air port 52 is connected to a pressure regulator bag 62 in cartridge 22 through an air channel 70.

Each PHA air port 58 is connected to air pump 36 through an air distribution manifold 64 and tubing 66. During a priming operation, air is pumped into and then vented from regulator bag 62 very quickly to alternately inflate bag 62 to push ink through ink ports 50, 56 to printhead assembly 14 and then deflate bag 62 to pull froth out of printhead assembly 14 into reservoir 60 through ink ports 50, 56. This push/pull cycle may be repeated several times to fill printhead assembly 14 with ink and to remove air from printhead assembly 14 into reservoir 60.

One example of a printhead assembly priming operation will now be described in detail with reference to the flow chart of FIG. 8 and the simplified side section views of FIGS. 9A-9D, which show one of the four PHA ink ports 56 and the adjoining ink fill chamber 68 in middle PHA housing 45. Referring to FIG. 9A, ink is supplied to PHA 14 through ink port 56 into ink fill chamber 68. Chamber 68 is part of ink flow passage 26 through which ink is delivered to printhead 24 (FIG. 1). A filter 72 at the bottom of chamber 68 filters contaminants from ink flowing to the printhead. Filter 72 also serves as a barrier to air moving up from the printhead into ink fill chamber 68. The ink level in FIG. 9A, indicated by line 74A in chamber 68, is low and air 75 has entered fill chamber 68, for example when an ink cartridge has been depleted and replaced with a new ink cartridge. Air from the printhead has also accumulated in a holding area 76 adjacent to filter 72. Ink level sensors 78 and 80 signal controller 34 (FIG. 1) the level of ink in chamber 68. The low ink condition shown in FIG. 9A is the start (block 810) for the priming operation shown in FIG. 8.

Figure 8:
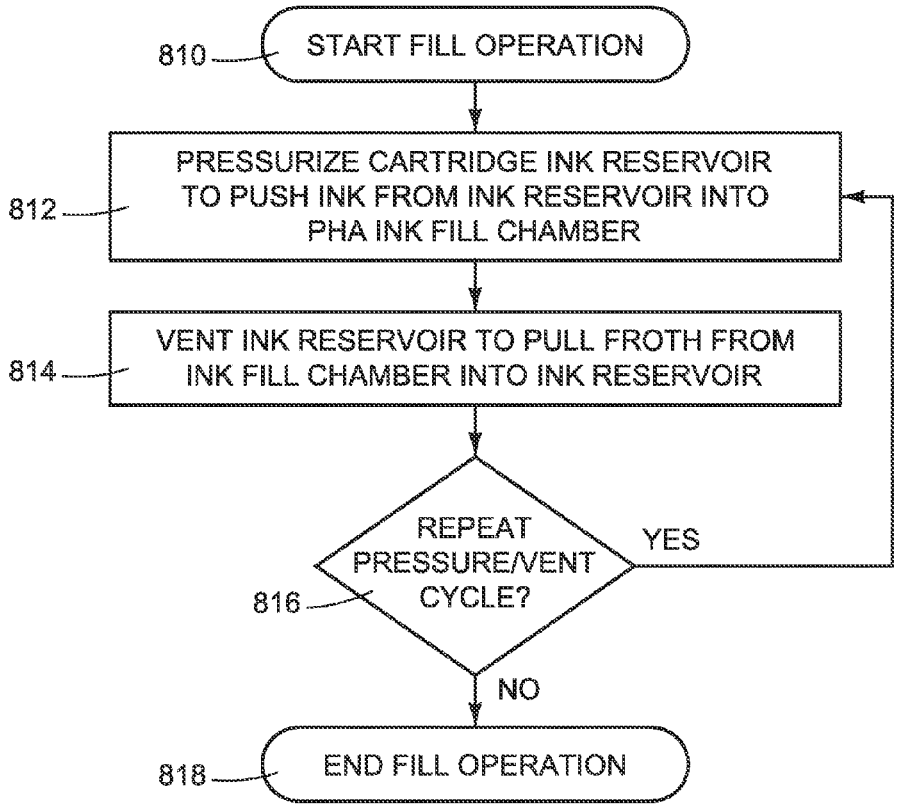
FIG. 8 is a flow chart illustrating one example of a new method for priming a printhead assembly.
Figure 9A:
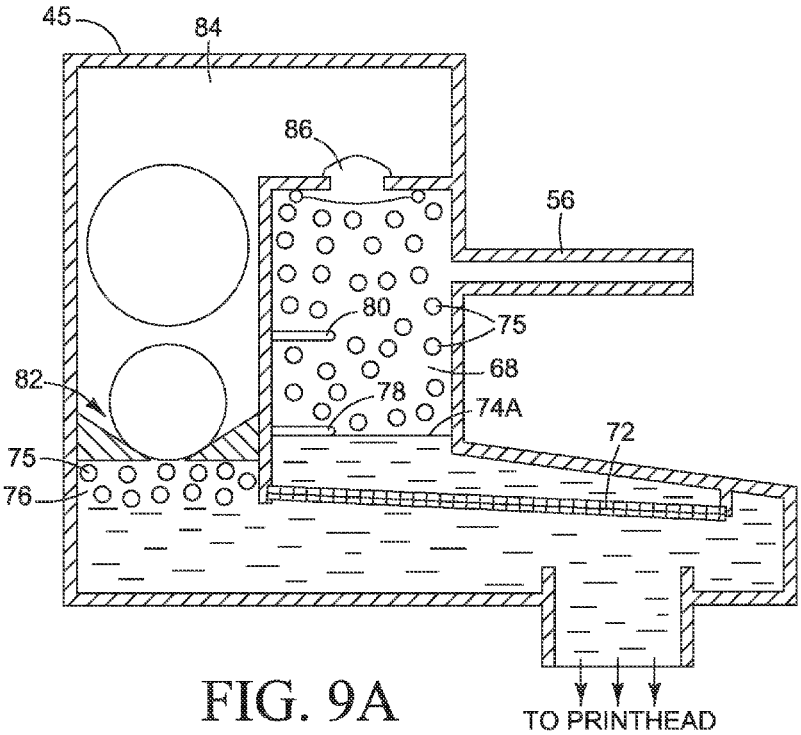
FIGS. 9A-9D are simplified side section views of part of a flow passage in the printhead assembly of FIGS. 5-7 illustrating a pressure/vent cycle from the priming method of FIG. 8.
Figure 9B:
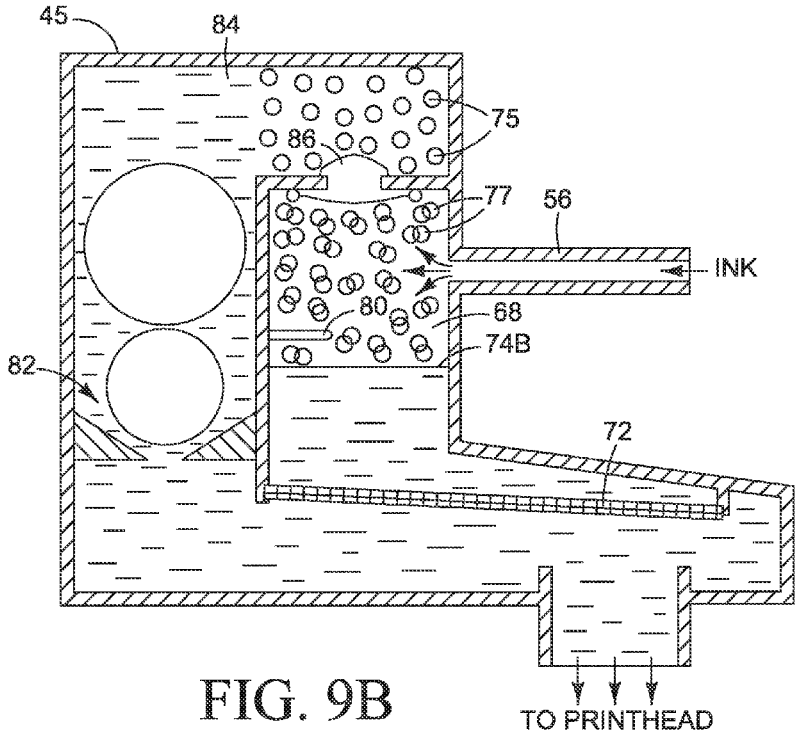
Figure 9C:
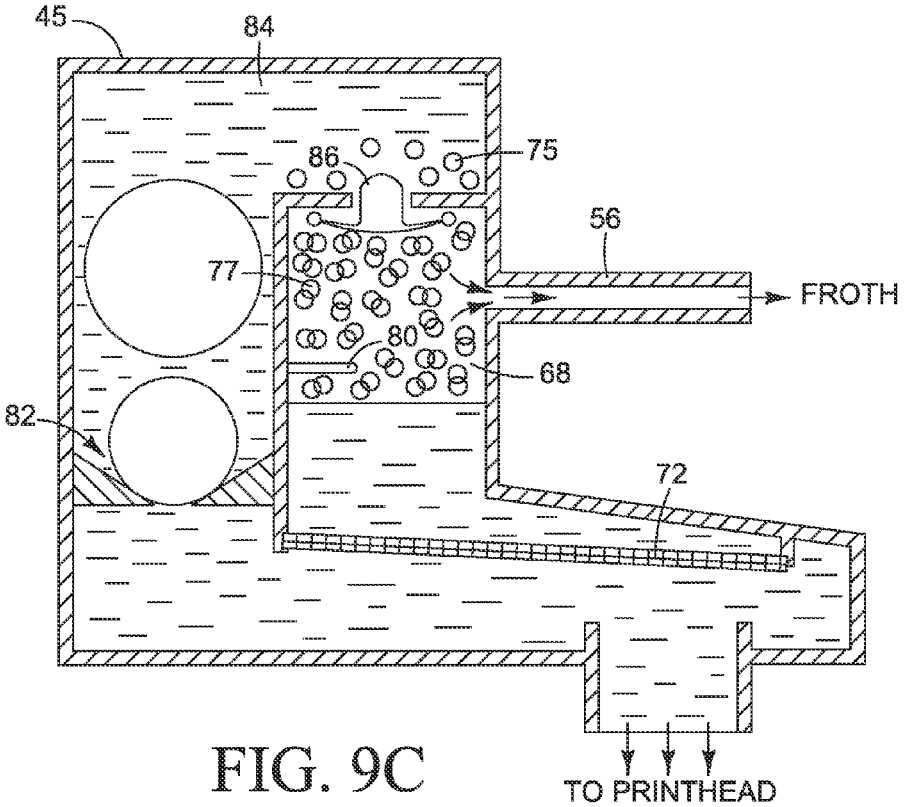
Figure 9D:
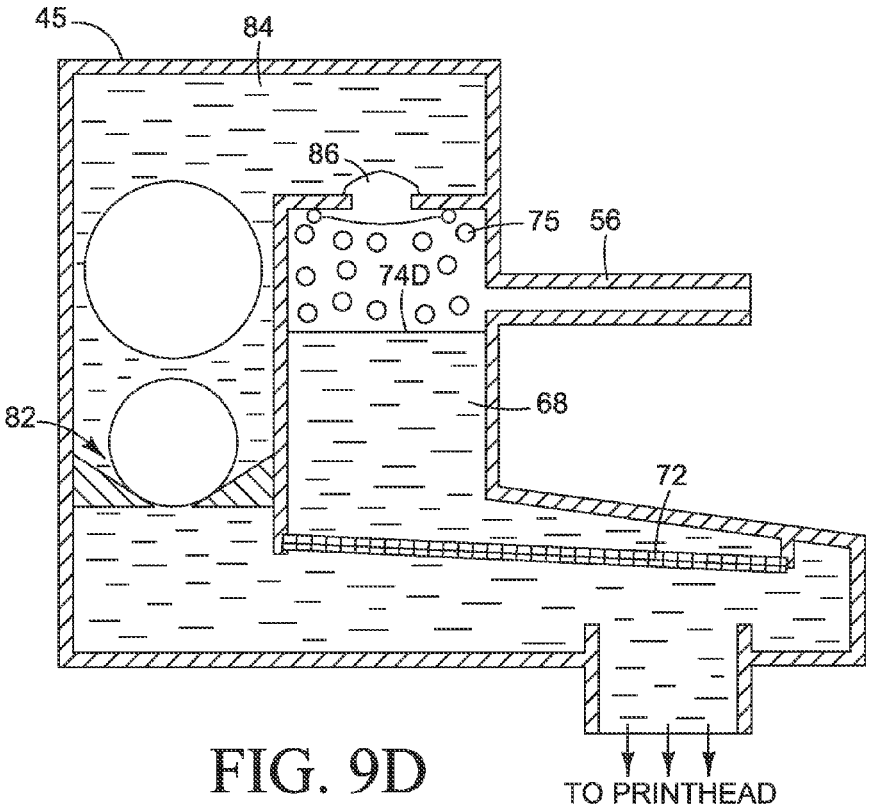

At block 812 in FIG. 8, programming 42 on controller 34 (FIG. 1) initiates a series of pressure/vent cycles for the PHA priming operation by starting pump 36 to inflate bag 62, pressurizing container ink reservoir 60 (FIG. 6) and pushing ink into fill chamber 68, as shown in FIG. 9B. The now higher ink level is indicated by line 74B in FIG. 9B. The higher pressure in fill chamber 68 opens ball valve 82 to allow air and ink from holding area 76 to enter a return chamber 84. Then, at block 814, pump 36 is stopped and bag 62 is vented to the atmosphere to pull froth 77 out of chamber 68 into ink reservoir 60 (FIG. 6) as shown in FIG. 9C. The lower pressure in fill chamber 68 closes ball valve 82 and opens an umbrella valve 86 to allow air in return chamber 84 to move into fill chamber 68 where it can be removed to container ink reservoir 60. The pressure/vent cycle is repeated at block 816 until ink level sensors 78, 80 signal controller 34 that the ink level 74D is adequate for printing operations, as shown in FIG. 90, or until a predetermined number of cycles is completed, and the priming operation is stopped (block 818).

The mixing of air and ink in fill chamber 68 during the pressure/vent cycles generates air/ink froth on top of the liquid ink in chamber 68. A significantly greater pressure differential is needed to move froth into ink reservoir 60 compared to air or ink alone. For the configuration of PHA 14 shown in FIGS. 9A-9D, it has been observed that, when froth is present in ink fill chamber 68, if the pressure difference between PHA chamber 68 and cartridge reservoir 60 is below a threshold needed to pull froth into reservoir 60, ink tends to be drawn back into reservoir 60. Consequently, it is desirable to consistently generate a sufficient pressure differential during venting to pull froth into cartridge reservoir 60.

Figure 10:
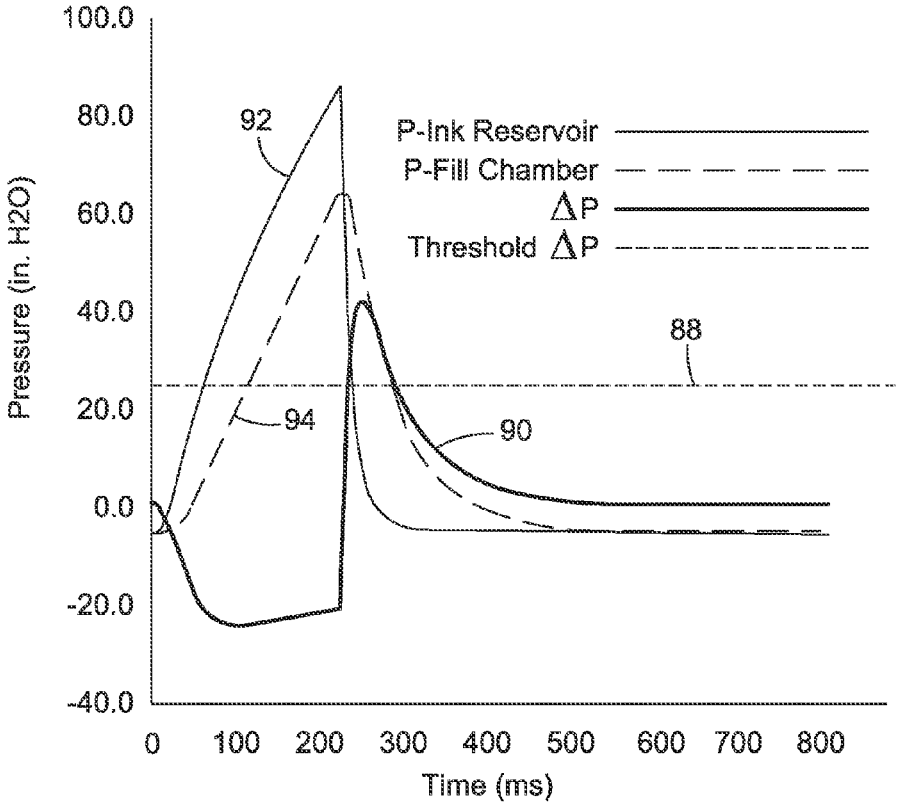
FIG. 10 is a graph illustrating one example of the pressure changes in a pressure/vent cycle for pulling froth from the printhead assembly into the ink cartridge using a carriage vent path such as that shown in FIGS. 11-14.

The graph of FIG. 10 illustrates one example of a pressure/vent cycle for pulling froth from ink fill chamber 68 into cartridge ink reservoir 60 for a PHA configuration such as that shown in FIGS. 9A-9D, The graph of FIG. 10 corresponds to a vent path through carriage vent 40 shown in FIGS. 11-14.

Referring first to FIG. 10, the horizontal line 88 at 25 inches of water indicates the pressure difference ($\Delta P$) between PHA chamber 68 and cartridge reservoir 60 needed to move froth from chamber 68 into reservoir 60. The heavy solid line 90 indicates the pressure difference between chamber 68 and reservoir 60 during a pressure/vent cycle. Lines 92 and 94 indicate the pressure in cartridge reservoir 60 and PHA ink fill chamber 68, respectively, during the pressure/vent cycle. The area above threshold $\Delta P$ line 88 and below the actual $\Delta P$ line 90 represents the volume of froth pulled into cartridge reservoir 60 during venting.

In the example shown in FIG. 10, during pressurization, pump 36 runs for about 200 milliseconds to increase the pressure in ink reservoir 60 from about −5 inches of water (the pressure in reservoir 60 during normal printing operations) to about 85 inches of water to push ink from reservoir 60 into PHA ink fill chamber 68, as shown in FIG. 9B. During venting, pump 36 is stopped and carriage vent 40 is opened. The pressure 92 in reservoir 60 drops quickly (more than 600 inches of water per second) so that $\Delta P$ 90 spikes to a level well above the threshold $\Delta P$ of 25 inches of water, pulling froth from chamber 68 into reservoir 60 (the area under line 90 above line 88). As noted above with reference to FIGS. 9A-9D, the pressure/vent cycle is repeated until ink level sensors 78, 80 signal controller 34 that the ink level 74D is adequate for printing operations or until a predetermined number of cycles is completed.

Figure 11:
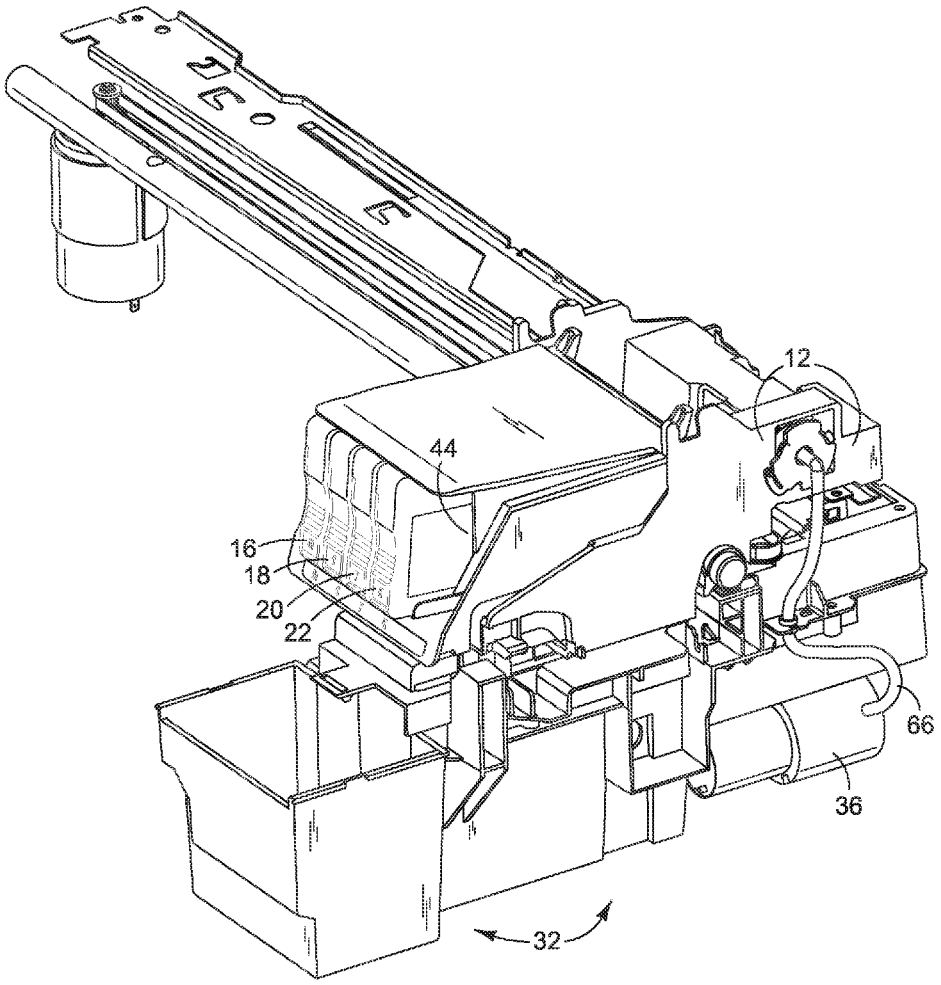
FIGS. 11-12 are perspective views and FIGS. 13-14 are block diagrams of a printer carriage and service station, such as might be used in the printer of FIG. 1, illustrating one example for a vent path corresponding to the graph of FIG. 10.
Figure 12:
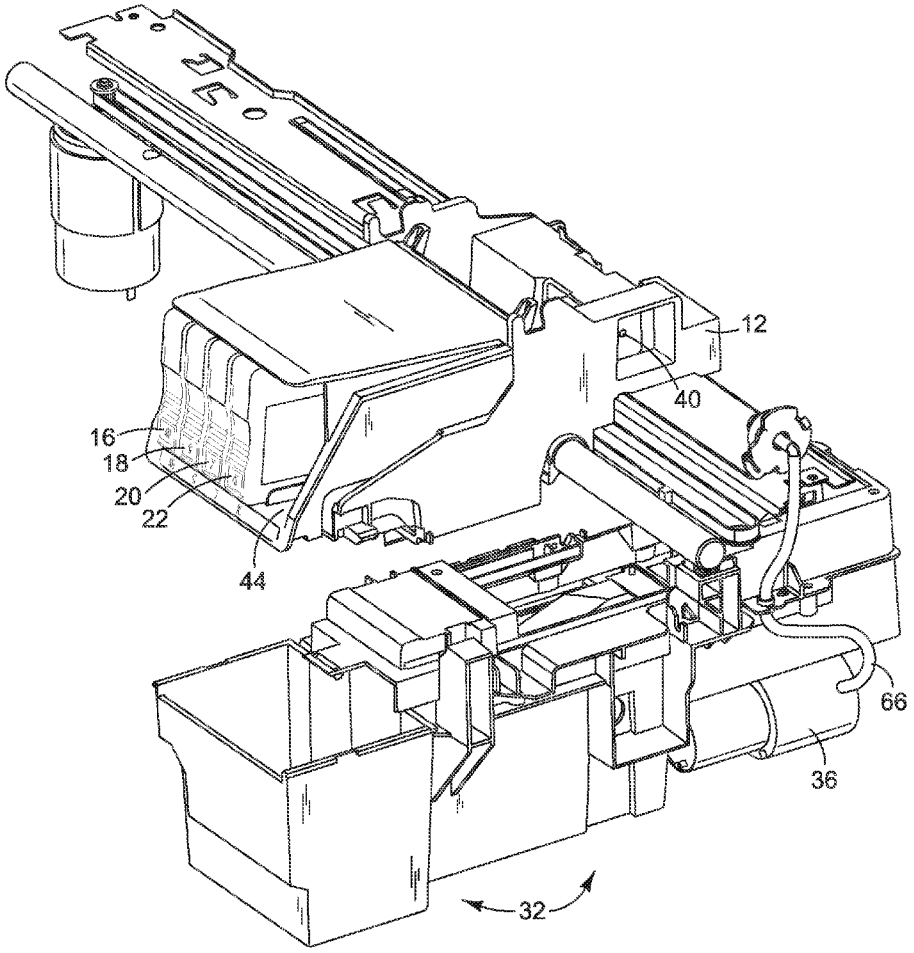
Figure 13:
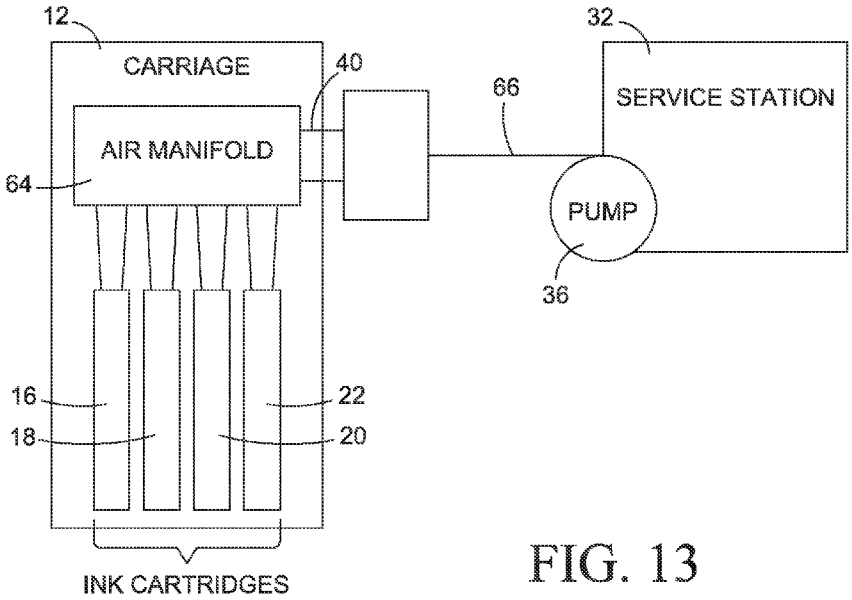
Figure 14:
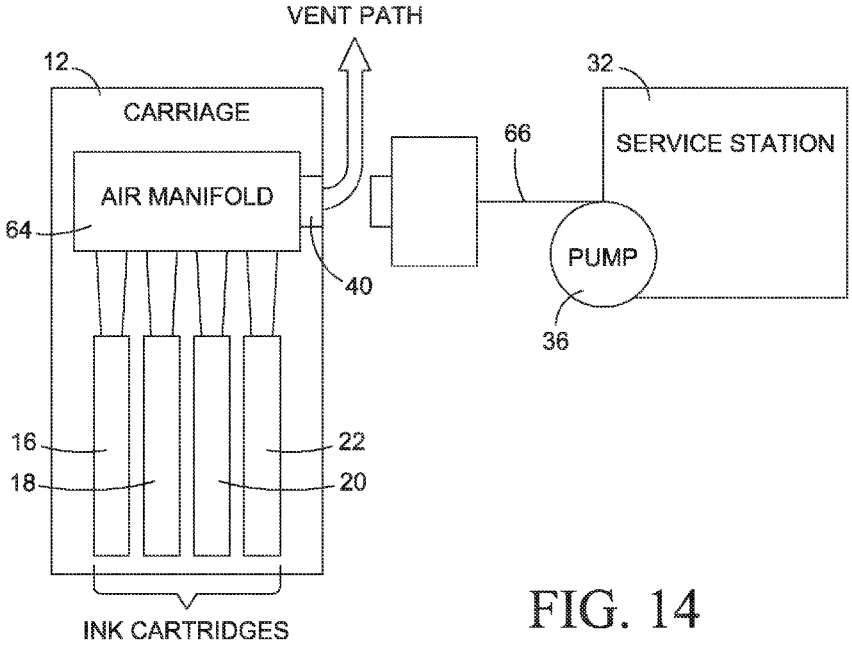

Referring now to FIGS. 11-14, during pressurization, carriage 12 is moved to a position over service station 32 to connect PHA air manifold 64 to air pump 36, and to close carriage vent 40, as shown in FIGS. 11 and 13. For venting, carriage 14 is moved away from service station 32, to disconnect air manifold 64 from air pump 36, and to open carriage vent 40, as shown in FIGS. 12 and 14. The example shown in FIGS. 11-14 uses (1) a single vent path for both printing and PHA priming operations (2) with a normal carriage motion to open and close the carriage vent during the pressure/vent cycle. Hence, a short vent path is implemented with no extra parts and minimal added control programming.

Figure 15:
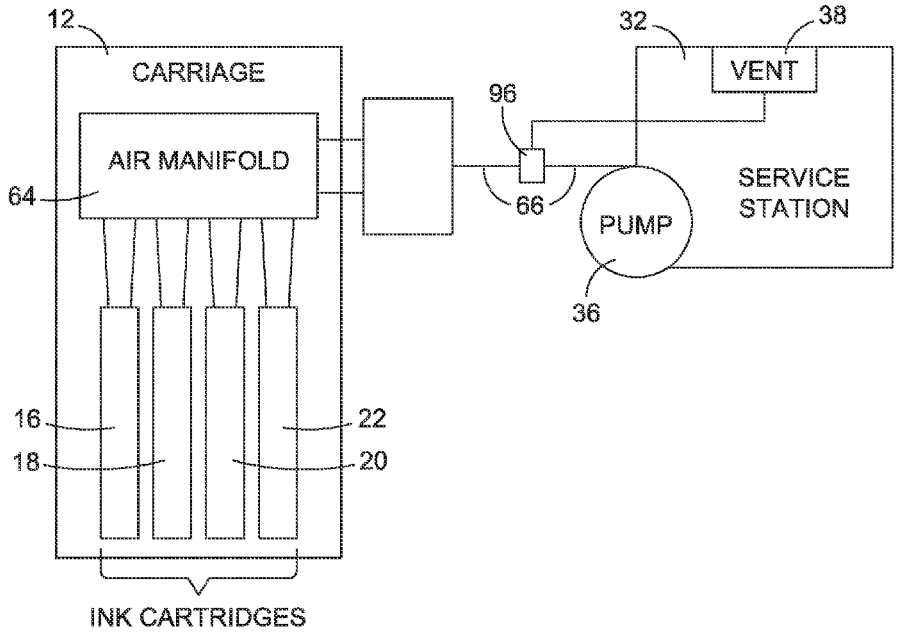
FIG. 15 is a block diagram of a printer carriage and service station, such as might be used in the printer of FIG. 1, illustrating one example for a service station vent path.

Other suitable venting mechanisms are possible. For example, the ink cartridges 16-22 could be vented through a vent 38 on service station 32 as shown in FIG. 15. In this example, carriage 14 remains stationary during venting. Service station vent 38 may be closed for pressurization and opened for venting through a valve 96 that controls the flow of air between PHA air manifold tube 66 and either pump 36 or service station vent 38. It has been observed, however, that a longer vent path through the service station for the PHA configuration shown in FIGS. 9A-9D may not allow sufficiently rapid venting to achieve a threshold ΔP for moving froth out of the printhead assembly into the ink cartridge. Hence, while the configuration of the PHA and the overall geometry of the vent path will affect the threshold ΔP and the actual ΔP, it is expected that a shorter vent path in general will allow faster venting to generate a higher ΔP for moving more froth, and that a ΔP of at least 25 inches of water will be needed to move froth in many inkjet PHA priming applications.

As noted at the beginning of this Description, the examples shown in the figures and described above illustrate but do not limit the invention. Other examples, embodiments and implementations are possible. Therefore, the foregoing description should not be construed to limit the scope of the invention, which is defined in the following claims.

What is claimed is:

1. A method for priming a printhead assembly, comprising:

pushing liquid from a container into the printhead assembly through a liquid port by positively pressurizing the container; and then pulling froth from the printhead assembly into the container through the liquid port by venting the pressurized container.

2. The method of claim 1, wherein:

pushing liquid from the container into the printhead assembly comprises inflating a bag in the container; and pulling froth from the printhead assembly into the container comprises deflating the bag.

3. The method of claim 2, wherein inflating the bag enlarges a volume of the bag and wherein deflating the bag decreases the volume of the bag.

4. The method of claim 1, wherein the pushing and pulling are alternated as a push/pull cycle and wherein the push/pull cycle and repeated until a liquid level in the printhead reaches a level adequate for printing operations or until a predetermined number of the push/pull cycles is completed.

5. The method of claim 1, wherein the pressurizing and venting is repeated until a liquid level in the printhead reaches a level adequate for printing operations or until a predetermined number of the pressurize/vent cycles is completed.

6. The method of claim 1, wherein venting the pressurized container comprises venting the pressurized container through a carriage carrying the printhead assembly.

7. The method of claim 6, wherein venting the pressurized container through the carriage comprises moving the carriage from a first a first position in which a vent on the carriage is closed to a second position in which the vent is open for venting the container.

8. The method of claim 1, wherein the pressurizing and the venting generate a pressure difference of at least 25 inches of water to pull froth from the printhead assembly into the container during venting.

9. The method of claim 1, wherein a first valve extends between the printhead assembly and a return chamber and wherein a second valve extends between the return chamber and the liquid port, wherein pushing the liquid from the container into the printhead assembly through the liquid port opens the first valve such that froth flows across the first valve into the return chamber and wherein froth is pulled from the return chamber through the second valve into the container through the liquid port.

10. A printer controller having programming thereon to:

pressurize an ink container to push ink from the container into a printhead assembly; and vent the pressurized container to pull froth from the printhead assembly into the container.

11. The controller of claim 10, wherein the programming includes programming to alternately pressurize the container and then vent the pressurized container until an ink level in the printhead reaches a level adequate for printing operations or until a predetermined number of the pressurize/vent cycles is completed.

12. The controller of claim 10, wherein the programming includes programming to vent the pressurized container through a movable carriage carrying the printhead assembly.

13. The controller of claim 10, wherein the programming includes programming to generate a pressure difference of at least 25 inches of water to pull froth from the printhead assembly into the container during venting.

14. The controller of claim 10 embodied at least in part in an application specific integrated circuit configured to execute the programming.

15. The controller of claim 10, wherein the container contains a bag and wherein the programming of the controller is to (1) inflate and enlarge a size of the bag within the container to push ink from the container into the printhead assembly and to (2) deflate and reduce the size of the bag to pull froth from the printhead assembly into the container.

16. The controller of claim 10, wherein the ink container contains a bag, wherein pressurizing the ink container comprises inflating the bag and wherein venting the pressurized container comprises deflating the bag.

17. The controller of claim 10, wherein the programming of the controller pressurizing the ink container pushes ink from the container into the printhead assembly through an ink port and wherein the programming of the controller venting the pressurized container pulls froth from the printhead assembly into the container through the ink port.

18. The controller of claim 10, wherein the printhead assembly is carried by a carriage and wherein the programming of the printer controller selectively moves the carriage between a first position in which the container is pressurized to pushing from the container into the printhead assembly and a second position in which the container is vented to pull froth from the printhead assembly into the container.

* * * * *

UNITED STATES PATENT AND TRADEMARK OFFICE

CERTIFICATE OF CORRECTION

PATENT NO. : 9,044,939 B2
APPLICATION NO. : 14/160610
DATED : June 2, 2015
INVENTOR(S) : Curt Gonzales et al.

It is certified that error appears in the above-identified patent and that said Letters Patent is hereby corrected as shown below:

In the claims

In column 6, line 3, in Claim 7, delete "a first a first" and insert -- a first --, therefor.

Signed and Sealed this
Seventh Day of June, 2016

Michelle K. Lee

Michelle K. Lee
*Director of the United States Patent and Trademark Office*